US006565155B1

(12) United States Patent
Huang

(10) Patent No.: US 6,565,155 B1
(45) Date of Patent: May 20, 2003

(54) CHAIR

(75) Inventor: William W. Huang, Industry, CA (US)

(73) Assignee: Norstar Office Products, Inc., City of Industry, CA (US)

( * ) Notice: Subject to any disclaimer, the term of this patent is extended or adjusted under 35 U.S.C. 154(b) by 0 days.

(21) Appl. No.: 10/054,251

(22) Filed: Jan. 22, 2002

(51) Int. Cl.[7] ..... B60N 2/02

(52) U.S. Cl. ..... 297/353; 297/411.41; 297/411.36; 297/411.4; 403/109.1; 403/109.4

(58) Field of Search ..... 297/353, 411.41, 297/411.1, 411.36; 248/229.2, 229.24; 403/109.4, 109.1, 109.6, 223

(56) References Cited

U.S. PATENT DOCUMENTS 4,065,176 A * 12/1977 Fontana ..... 297/301.3
4,632,458 A * 12/1986 Brown et al. ..... 297/353
5,405,189 A * 4/1995 Stumpf ..... 297/353
5,711,576 A * 1/1998 Olson et al. ..... 297/353
5,769,497 A * 6/1998 Tsai ..... 297/411.36
6,193,315 B1 * 2/2001 Hoshino ..... 297/353
6,354,664 B1 * 3/2002 Chen ..... 297/353

OTHER PUBLICATIONS

Yoo, Pub. No. US 2002/0033626 A!.*

* cited by examiner

*Primary Examiner*—Peter M. Cuomo
*Assistant Examiner*—Erika Garrett
(74) *Attorney, Agent, or Firm*—Alan Kamrath; Rider, Bennett, Egan & Arundel, LLP

(57) ABSTRACT

A chair comprises an arm mechanism and a back mechanism each having an adjustment screw for releasably securing a sleeve and a shroud to a J-bar so that a height of either arm or back mechanism can be adjusted relative to the j-bar. Also, a protruded enlargement is formed at a top end of the upright backrest support.

2 Claims, 6 Drawing Sheets

CHAIR

FIELD OF THE INVENTION

The present invention relates to chair and more particularly to such a chair with both height adjustable backrest and arms.

BACKGROUND OF THE INVENTION

Chairs have either height adjustable backrest or arms are well known. Further, chairs having one of components other than backrest and arms being adjustable relative to the other element are well known. But chairs having both height adjustable backrest and arms have not been disclosed. Accordingly, the invention has resulted from efforts to develop such an improved chair.

SUMMARY OF THE INVENTION

It is therefore an object of the present invention to provide a chair comprising an upright backrest support having one end attached to a seat; an arm mechanism comprising a first sleeve put on a lower part of the upright backrest support, the first sleeve having two parallel longitudinal first slits open to a top and a first hole between the longitudinal first slits adjacent the top, a first half shroud, a second half shroud, the first and the second half shrouds releasably secured on the first sleeve, a first adjustment screw in the first hole, and an arm assembly releasably secured to the first and the second half shrouds; and a back mechanism comprising a second sleeve put on an upper part of the upright backrest support, the second sleeve having two parallel longitudinal second slits open to a top, a second hole between the longitudinal second slits adjacent the top, a third half shroud, a fourth half shroud, the third and the fourth half shrouds releasably secured on the second sleeve, a second adjustment screw in the second hole, and a backrest releasably secured to the third and the fourth half shrouds; wherein in adjusting a height of the arm mechanism, unscrew the first adjustment screw for disengaging the first sleeve from the upright backrest support, slide the first and the second half shrouds and the first sleeve to a first predetermined position, and drive the first adjustment screw to secure the first sleeve to the upright backrest support at the first predetermined position; and in adjusting a height of the back mechanism, unscrew the second adjustment screw for disengaging the second sleeve from the upright backrest support, slide the third and the fourth half shrouds and the second sleeve to a second predetermined position, and drive the second adjustment screw to secure the second sleeve to the upright backrest support at the second predetermined position.

In one aspect of the present invention, a top end of the upright backrest support is shaped like a protruded enlargement for supporting a coat or the like.

The above and other objects, features and advantages of the present invention will become apparent from the following detailed description taken with the accompanying drawings.

DETAILED DESCRIPTION OF THE PREFERRED EMBODIMENTS

Figure 1:
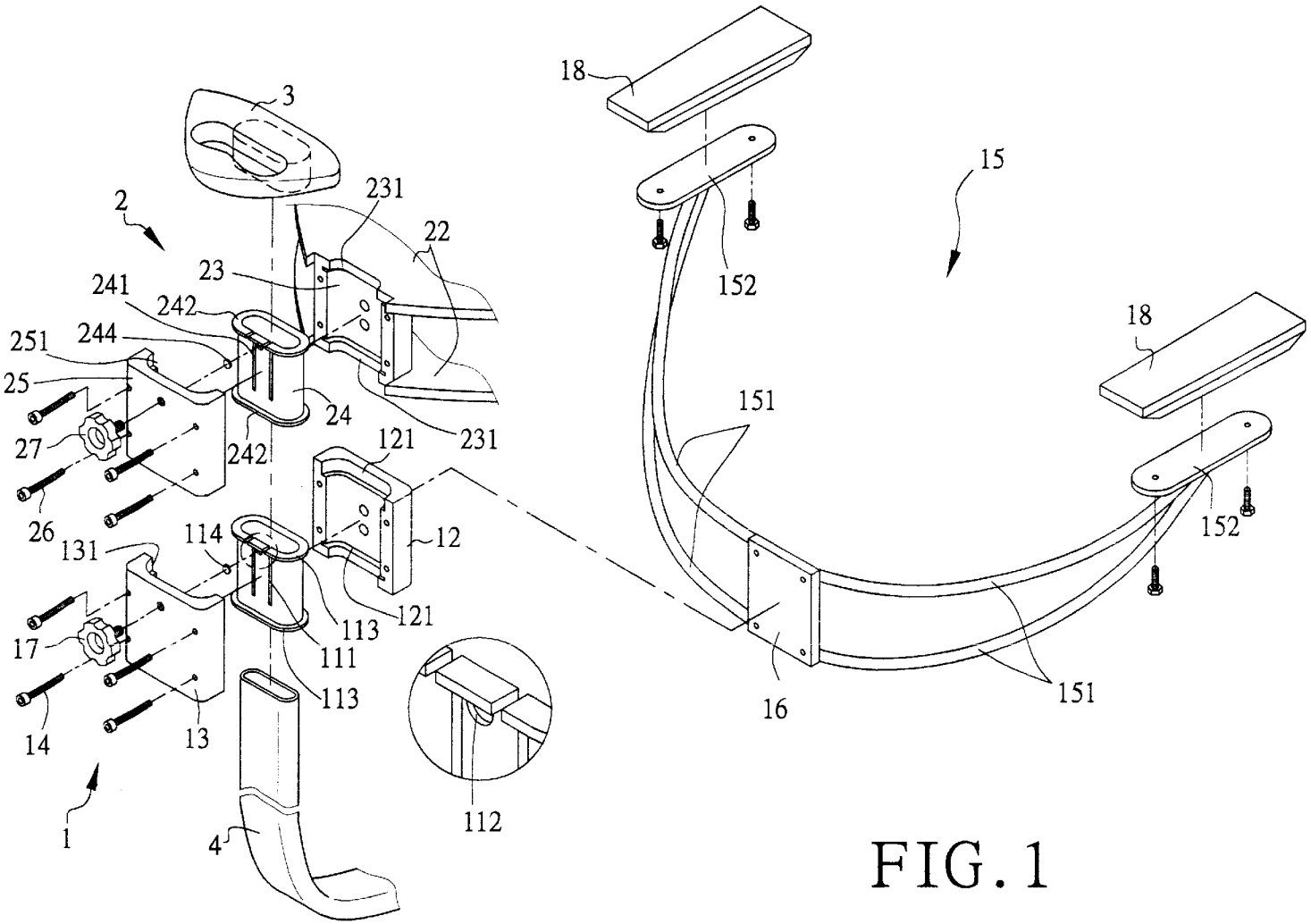
FIG. 1 is an exploded view of height adjustable arm mechanism and back mechanism of a chair according to the invention.
Figure 2:
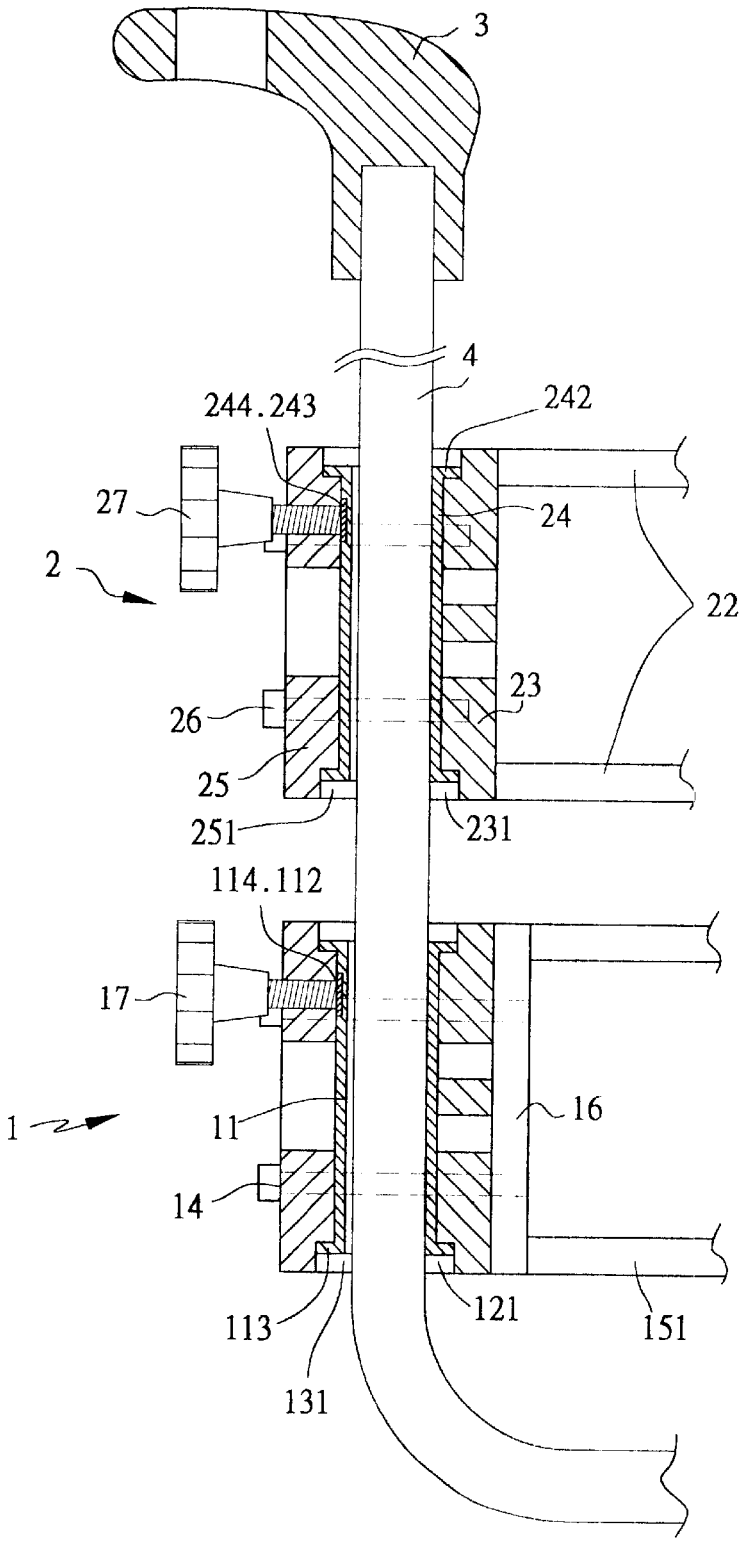
FIG. 2 is a cross-sectional view of a main portion of the assembled arm mechanism and back mechanism of FIG. 1.
Figure 3:
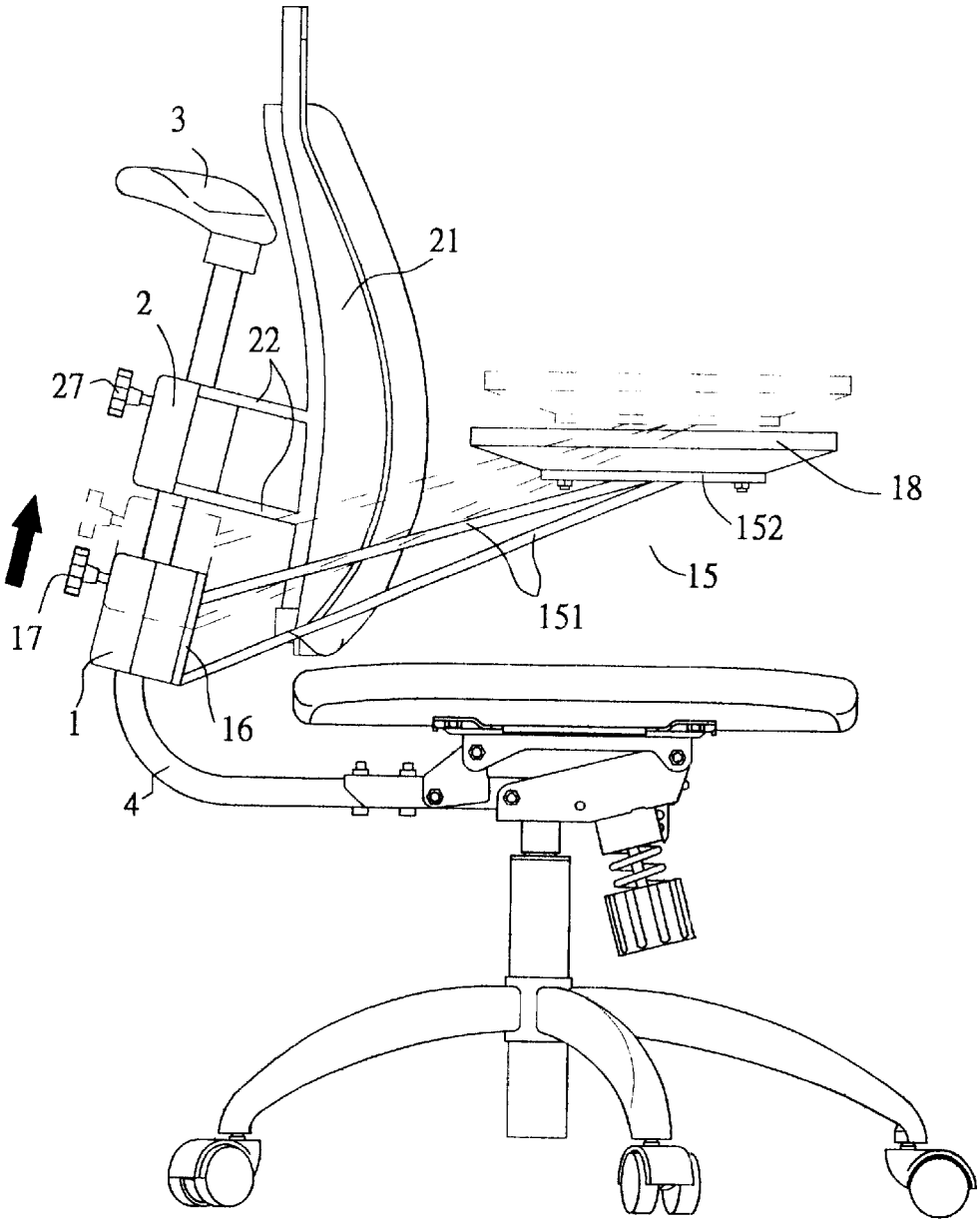
FIG. 3 is a side view of a chair incorporating arm mechanism and back mechanism of FIG. 1 showing the height of arms being adjusted.

Referring to FIGS. 1 and 2, there is shown portions (e.g., arm mechanism 1, back mechanism 2, ear 3 and upright backrest support 4) of a chair constructed in accordance with the invention. Each of above components will now be described in detail below.

Upright backrest support or J-bar 4 has one end attached to seat and the other top end attached to ear 3. Arm mechanism 1 comprises a sleeve 11 put on lower part of upright backrest support 4, sleeve 11 having two parallel longitudinal slits 111 open to top, a hole 112 between the longitudinal slits 111 adjacent the top, and a washer 114 disposed in hole 112, a first half shroud 12 having an inner recess 121, a second half shroud 13 having an inner recess 131, half shrouds 12 and 13 together fitted between top and bottom peripheral flanges 113, a plurality of fasteners (e.g., screws) 14 driven through half shrouds 13 and 12 to secure them together, an adjustment screw 17 driven through washer 114, and an arm assembly 15 including a rear plate 16 secured to first half shroud 12 and second half shroud 13 by driving screws 14 through second half shroud 13, longitudinal slits 111, first half shroud 12, and rear plate 16, two arm tubes 151 extended from both sides of rear plate 16, two top plates 152 on ends of arm tubes 151, and two arm pads 18 threadedly secured onto top plates 152.

Back mechanism 2 comprises a sleeve 24 put on upper part of upright backrest support 4, sleeve 24 having two parallel longitudinal slits 241 open to top, a hole 243 between the longitudinal slits 241 adjacent the top, and a washer 244 disposed in hole 243, a first half shroud 25 having an inner recess 251, a second half shroud 23 having an inner recess 231, half shrouds 25 and 23 together fitted between top and bottom peripheral flanges 242, a plurality of screws 26 driven through half shrouds 25 and 23 to secure them together, an adjustment screw 27 driven through washer 244, and a backrest bracket 22 rigidly affixed to second half shroud 23 which is in turn secured to sleeve 24 by driving screws 26 through first half shroud 25, longitudinal slits 241, and first half shroud 23.

Figure 4:
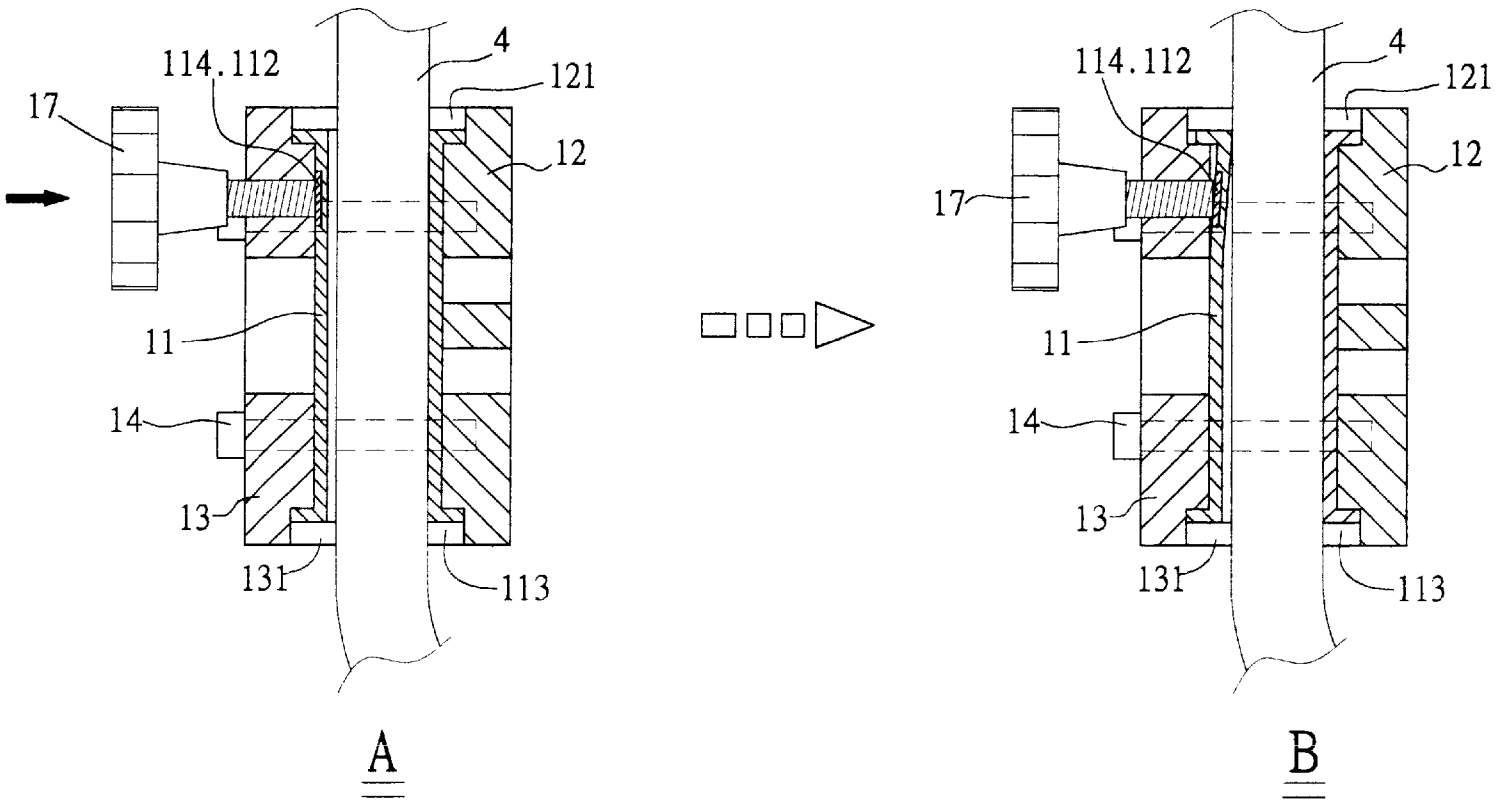
FIGS. 4A and 4B are cross-sectional views showing the details of adjusting the height of arms.

Referring to FIG. 4, the height adjustment of arm mechanism 1 will now be described. First appropriately unscrew adjustment screw 17 until sleeve 11 is clear from the engagement of upright backrest support 4. Then slide half shrouds 12 and 13 and sleeve 11 to a desired position. Finally, drive adjustment screw 17 to secure sleeve 11 to upright backrest support 4 at the desired position. Note that the height adjustment of back mechanism 2 is a mirror image of that of arm mechanism 1. Thus a detailed description thereof is omitted herein for the sake of brevity.

Figure 5:
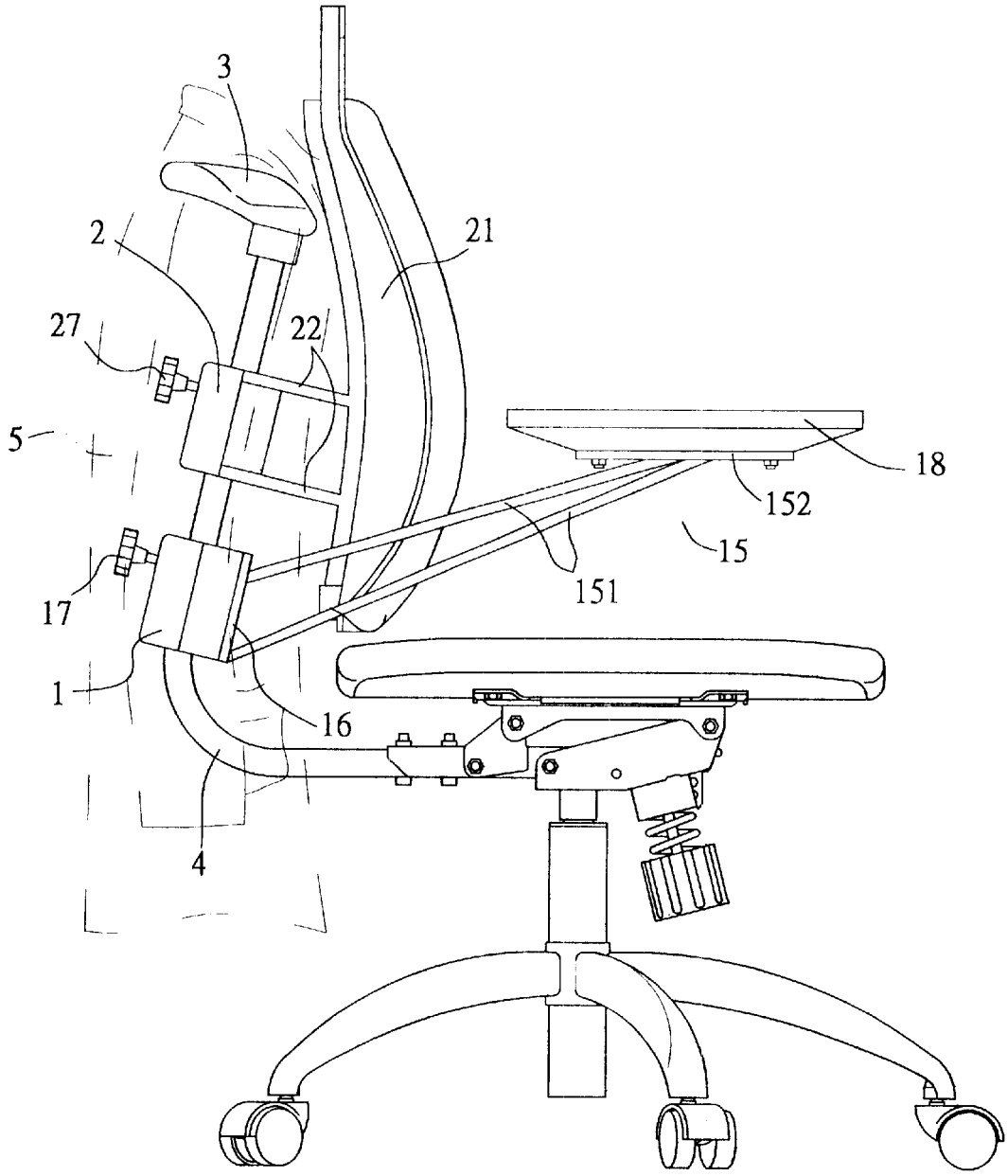
FIG. 5 is a side view of the chair of FIG. 3 with a coat hung on ear on top of back mechanism.
Figure 6:
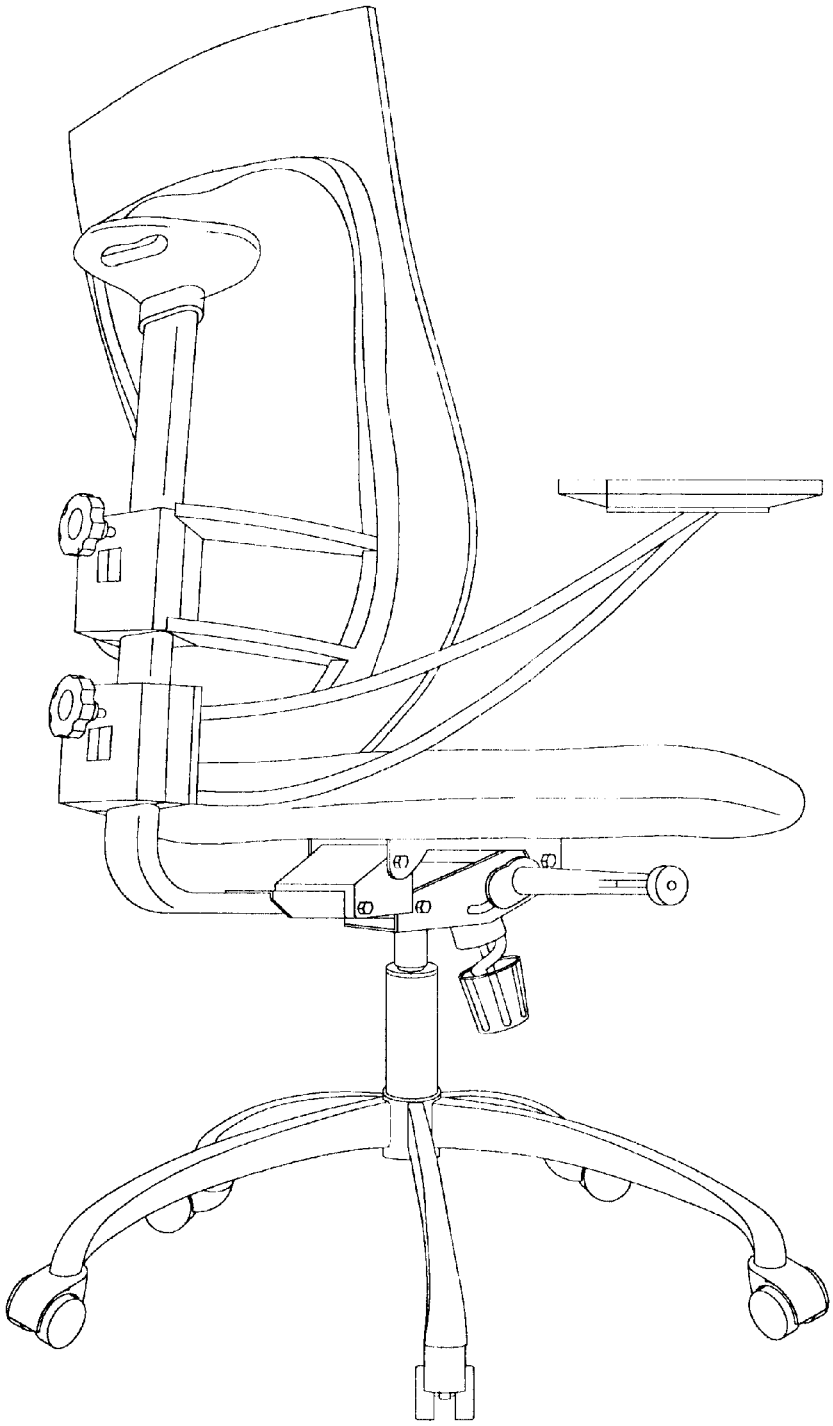
FIG. 6 is a perspective view of a chair according to the invention.

FIG. 5 is a side view of the chair with a coat 5 hanged on ear 3. FIG. 6 shows a chair according to the invention.

While the invention has been described by means of specific embodiments, numerous modifications and variations could be made thereto by those skilled in the art without departing from the scope and spirit of the invention set forth in the claims.

What is claimed is:

1. A chair comprising:

an upright backrest support having one end attached to a seat;

an arm mechanism comprising a first sleeve on a lower part of the upright backrest support, the first sleeve having two parallel longitudinal first slits opening toward to a top portion therewith and a first hole located between the longitudinal first slits adjacent the top portion; a first half shroud and a second half shroud, provided without the first sleeves the first and second half shrouds releasably secured on the first sleeve, a first adjustment screw provided in the first hole, and an arm assembly releasably secured to the first and second half shrouds; and a back mechanism comprising a second sleeve mounted on an upper part of the upright backrest support, the second sleeve having two parallel longitudinal second slits opening toward a top portion, a second hole located between the longitudinal second slits adjacent the top portion; a third half shroud provided about the second sleeve, the third and fourth half shrouds releasably secured on the second sleeve, a second adjustment screw provided in the second hole, and a backrest releasably secured to the third and fourth half shrouds;

wherein in adjusting a height of the arm mechanism, the first adjustment screw is loosened for disengaging the first sleeve from the upright backrest support, the first and second half shrouds and the first sleeve to a first predetermined position, and is driven the first adjustment screw to secure the first sleeve to the upright backrest support at the first predetermined position; and in adjusting a height of the back mechanism, the second adjustment screw is loosened for disengaging the second sleeve from the upright backrest support, the third and the fourth half shrouds and the second sleeve are slide to a second predetermined position, and is driven the second adjustment screw to secure the second sleeve to the upright backrest support at the second predetermined position.

2. The chair of claim 1, further comprising a protruded enlargement at the other end of the upright backrest support.

* * * * *